United States Patent [19]

Hoffmüller

[11] 4,328,860

[45] May 11, 1982

[54] RECUPERATOR FOR HEAT EXCHANGE BETWEEN FLOW MEDIA OF DISSIMILAR TEMPERATURES

[75] Inventor: Wilhelm Hoffmüller, Munich, Fed. Rep. of Germany

[73] Assignee: Motoren- und Turbinen-Union Munchen, GmbH, Munich, Fed. Rep. of Germany

[21] Appl. No.: 148

[22] Filed: Jan. 2, 1979

[30] Foreign Application Priority Data

Dec. 30, 1977 [DE] Fed. Rep. of Germany ..... 2758998

[51] Int. Cl.[3] ..... F28F 5/00

[52] U.S. Cl. ..... 165/81; 165/83

[58] Field of Search ..... 165/81-83, 165/81.82, 158

[56] References Cited

U.S. PATENT DOCUMENTS 3,129,931 4/1964 Stookey ..... 165/82
3,294,159 12/1966 Kuvalik et al. ..... 165/81
4,134,449 1/1979 Haye et al. ..... 165/83

FOREIGN PATENT DOCUMENTS 1374610 8/1964 France ..... 165/158
438666 11/1935 United Kingdom ..... 165/81

*Primary Examiner*—Samuel Scott
*Assistant Examiner*—Theophil W. Streule
*Attorney, Agent, or Firm*—Craig & Antonelli

[57] ABSTRACT

A recuperator for heat exchange between two flow media of dissimilar temperatures is formed by a housing containing the flow of a first of the two flow media and a plurality of essentially parallel slidably supported tubes containing the flow of the second flow medium. The tubes are made of a highly heat resistant material, such as ceramic material, and are biased at one end by an expansion pressure device that acts upon flow deflection connectors at the one end of the tubes. In one preferred embodiment, the expansion pressure means utilizes spring force, while in other preferred embodiments, the expansion pressure device uses a compressible medium for applying the biasing force.

11 Claims, 8 Drawing Figures

RECUPERATOR FOR HEAT EXCHANGE BETWEEN FLOW MEDIA OF DISSIMILAR TEMPERATURES

BACKGROUND AND SUMMARY OF THE INVENTION

This invention relates to a recuperator for heat exchange between flow media of dissimilar temperatures, and in a broad aspect it provides a recuperator that is easy to maintain and is configured such that it can still be used when the hotter of the two flow media is at a temperature of at least 1000° C.

It is a particular object of the present invention to provide a recuperator wherein a housing containing the flow of the first of two flow media also has a plurality of essentially parallel tubes containing the flow of the second flow medium arranged therein. According to a preferred embodiment these tubes are made of a highly heat-resistant ceramic material and extend at right angles to the direction of flow of the first flow medium around the tubes for causing a meandering of the second flow medium through the tubes. In a further feature of the invention, at least two tubes at a time are interconnected at adjacent ends by means of a component of a highly heat-resistant material. This component deflects the flow from the one tube into the other tube, and pressure is applied to that surface of the respective component which points away from the tube ends so as to urge the component against the tube ends.

The recuperator of the present invention provides an advantage in that for the tubes, use can be made of high-strength ceramic materials of any coefficient of thermal expansion, in that maintenance is very simple, the various tubes being readily replaced, and in that the use of highly heat-resistant ceramic materials for the tubes enables heat exchange to be achieved between two flow media of temperatures in the 1000° to 1400° C. range.

In a further aspect of the present invention, an expansion mechanism to generate the above-noted pressure, which acts on those surfaces of the components which point away from the tube ends, is provided between a first wall of the housing and the components arranged at the one ends of the tubes, said expansion mechanism operating on the force of a spring or pressure medium that operationally abutts on the one wall of the housing, and acting on the components arranged at the one end of the tubes to urge the components against the one tube ends thereby c using the tubes to press against the components arranged at the other tubes ends, said components in turn abutting on a second, opposite wall of the housing.

As expansion mechanisms, use can be made either of spring-loaded bolts or compressed-air cylinders equally made of highly heat-resistant ceramic materials.

In a further aspect of the present invention a pressure chamber is optionally arranged, in lieu of an expansion mechanism, between the components at the one tube ends and the adjacent wall of the housing, which pressure chamber develops pressure when in operation to act on that surface of the components which points away from the one tube ends to urge the components against the tube ends.

According to a further preferred embodiment, the pressure chamber is defined by a pressurizeable elastic foil of a highly heat resistant material disposed between the components and the wall of the housing.

In a further aspect of the present invention each of the noted deflecting components has a number of annular slots corresponding to the number of tubes to be interconnected by this component, in which annular slots are inserted the adjacent ends of the tubes to be interconnected by this component.

In a preferred aspect of the present invention a seal is provided in each annular slot between the tube ends inserted into said annular slot and the bottom of the annular slot, where the seal can be either a highly heat-resistant, ceramic or metal felt material.

Another arrangement for connecting the tube ends to the components according to the invention is to make each component snugly fit the contour of the tube ends connected to this component, where each component and the tube ends connected to this component preferably have spherical mating surfaces. This arrangement provides an advantage in that the need for an additional seal between the mating surfaces of the components and tubes is eliminated, in that the recuperator can be assembled at a faster rate, and in that even in the presence of minor rotary movements of the tubes about their ends the sealing effect between the components and the tubes will continue unchanged.

In a still further aspect of the present invention, the tubes are arranged and stacked in layers and the components are a snug fit one with the other, the tubes being spaced apart to permit the flow of the first flow medium between them. In a preferred aspect, the ends of at least two tubes of respective uppermost and lowermost layers of tubes are interconnected by means of an adaptor designed for the ingress and egress of the second flow medium, the components of the respective layer of tubes above and below being snug fit with the adaptors and two adjacent adaptors at a time being urged against the one ends of the tubes connected by said two adaptors by means of one of the expansion mechanisms.

In yet another feature of the present invention, components interconnecting three tubes at a time can be used instead of the noted two tube connecting components, the flow being deflected from one tube into the two others, or from two tubes into the remaining tube. This provides an advantage in that the position of the components is defined statically.

The recuperator of the present invention is suitable especially for use in a vehicular gas turbine engine fitted with a regenerative heat exchanger made of a ceramic material. The recuperator of the present invention is then arranged in the turbine operating cycle such that the hot steam of exhaust gas, when issuing from the turbine, will first flow through the recuperator of the present invention and then through the regenerative heat exchanger.

These and further objects, features and advantages of the present invention will become more obvious from the following description when taken in connection with the accompanying drawings which show, for purposes of illustration only, plural embodiments in accordance with the present invention.

DETAILED DESCRIPTION OF THE PREFERRED EMBODIMENT

Figure 1:
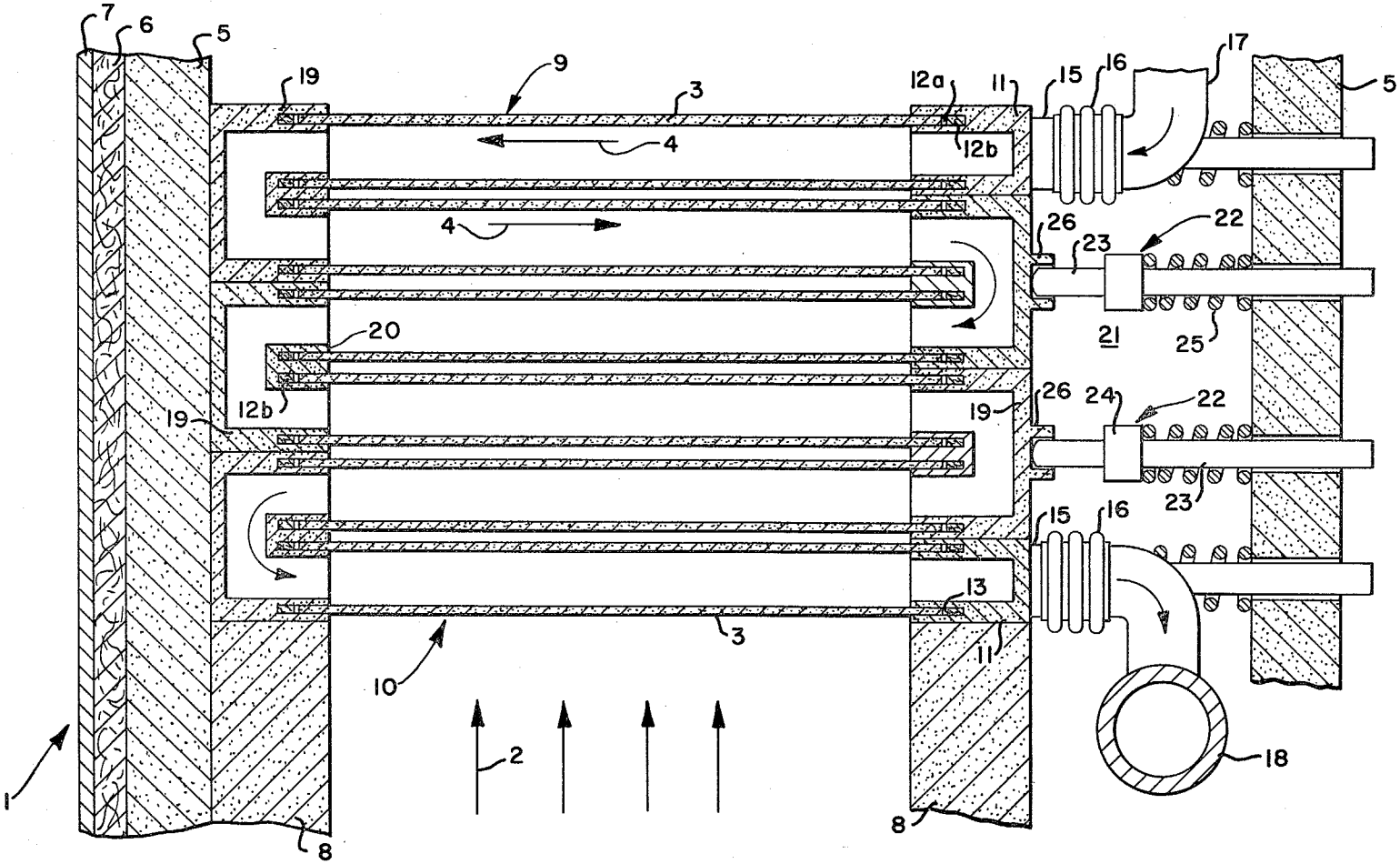
FIG. 1 is a schematic sectional view illustrating the recuperator of the present invention.
Figure 2:
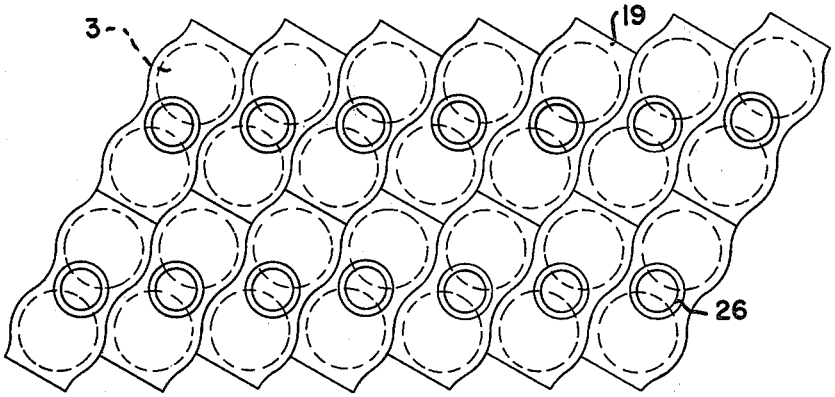
FIG. 2 is a rear view illustrating the stacked tubes of the recuperator of FIG. 1 in schematic representation, with the uppermost and lowermost row of tubes omitted.
Figure 3:
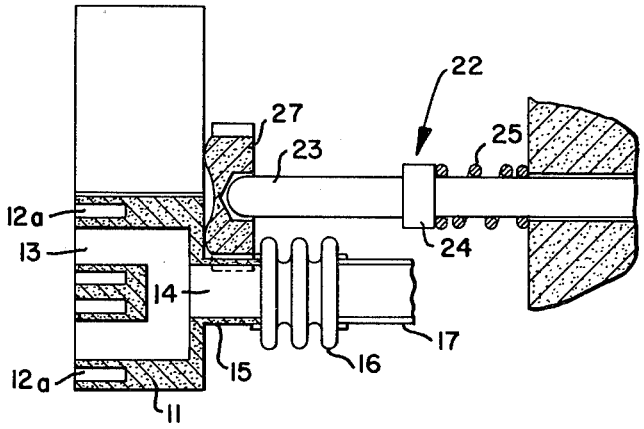
FIG. 3 is a sectional view illustrating an adaptor for two tubes of the uppermost and lowermost row of tubes and an expansion mechanism for urging this adaptor against the tubes.

With reference now to FIGS. 1, 2 and 3, the recuperator of the present invention comprises a housing 1 which, when the recuperator is operating, permits the flow of a first flow medium in the direction of arrowheads 2, and a stack of parallel ceramic tubes 3 slideably arranged in the housing 1 at right angles to the direction of flow of the first flow medium and which, when the recuperator is operating, permits the flow of a second flow medium in the direction of arrowheads 4 for heat exchange with the first flow medium. The tubes 3 are spaced apart to permit the flow of the first flow medium between the tubes. The first flow medium 2, flowing through the housing 1, is preferably the hotter of the two flow media.

When the recuperator arranged in accordance with the present invention is used on a vehicular gas turbine, the stream of hot gas issuing from the turbine is carried through the housing before it is allowed to enter the regenerative heat exchanger, while the compressor air ducted and heated in its passage through the regenerative heat exchanger flows through the tubes 3.

The wall of the housing comprises several layers, consisting of, proceeding from the inner to the outer end, a ceramic plate 5, an insulating felt 6 and a metal sheet wall 7. The stack of tubes rests on a ceramic rectangular member 8 arranged within the housing 1, through which flows the first flow medium when the recuperator is operating.

Two adjacent tubes 3 at a time of the uppermost row of tubes 9 and the lowermost row of tubes 10 are connected at their right-hand (on the drawing) ends to an adaptor 11 more closely illustrated in FIG. 3. Each adaptor 11 has two adjacent annular slots 12*a* for insertion of the ends of the two tubes 3 connected to the adaptor 11. To prevent leakage between the tubes 3 and the respective adaptor 11, a felt ring 12*b* of a highly heat-resistant ceramic or metallic material is inserted into the annular slot 12*a* before the tube ends are installed.

In the interior of each adaptor 11 is a U-shaped duct 13 the legs of which issue into the tubes 3 connected to said adaptor 11. Provided in the wall of the adaptor 11 opposite the tube ends is a passage 14 establishing communication between the U-shaped duct 13 and a pipe 15 fitted to that side of the wall of the respective adaptor 11 which points away from the tube ends. Seated over the free end of each pipe 15 is the end of a metal bellows 16, the other end of which is seated over a pipe elbow 17. The pipe elbows 17 communicating with the tubes 3 of the uppermost row of tubes 9 and the lowermost row of tubes 10 are each connected to one of two rigid pipes 18 arranged one over the other, of which FIG. 1 only shows the lower pipe. In operation of the recuperator, the first flow medium is admitted to the stack of tubes through the upper rigid pipe and is again carried away through the lower rigid pipe. Compensation for thermal expansion of the tubes 3 is achieved by the metal bellows 16, such that thermal stresses arising between the tubes 3 and the rigid pipes 18 are prevented to a great extent.

Each ceramic tube 3 arranged between the upper row 9 and the lower row 10 is connected at its respective one end to the adjacent end of the next higher tube 3, and at its other end to the adjacent end of the next lower tube 3, by means of a flow deflection component 19, which is designed to deflect the flow from one tube 3 into the other tube 3, so that when the recuperator is operating, the flow through the stack of tubes takes a meandering course at right angles to the direction of flow of the first flow medium 2 passing through the housing 1. The deflection components 19 are made of a highly heat-resistant material, such as a ceramic material. Each component 19 exhibits two annular slots 20 arranged one above the other to accommodate the adjacent ends of the tubes 3 interconnected thereby. As with the adaptors 11, felt rings 12*b* are inserted into the annular slots before the tube ends are installed in the annular slots 20, and the components 19, likewise, have an internal U-shaped duct the legs of which issue into the interconnected tubes 3. The components 19 have corrugated side walls of conforming contours, so that their rear walls—as it will be seen from FIG. 2—interfit to form a closed surface area.

A space 21 is provided, between the adaptors 11, the components 19 (arranged between the adaptors 11 on the right-hand side of the stack of tubes) and the right-hand housing plate 5, in which a number of expansion mechanisms 22 for urging the adaptors 11 and the components 19 arranged on this side against the tube ends are heated. Each expansion mechanism 22 has a ceramic pin 23, a portion of which is slideably carried in a hole in the right-hand plate 5 of the housing, and of which another portion projects into the space 21. On the portion projecting into space 21, each ceramic pin 23 has a collar 24 which has a bearing surface on its side facing the right-hand plate 5 against which one end of a coil sring 25 (which is seated over the ceramic pin 23 and the other end of which bears on the right-hand plate of the housing) bears to urge the ceramic pin towards the stack of tubes. One component 19 or two adaptors 11 are urged towards the tube ends by means of one ceramic pin 23. The one ends of those ceramic pins 23 that serve for urging the components 19 into contact are each located radially in a pipe end 26 formed on the rear side of the components 19, are radiused, and are in direct contact with the surface of the components 19 (FIG. 1). The one end of each ceramic pin 23 used for urging two each adaptors 11 into contact is radiused and fits into a recess in a ceramic plate 27, the surface of which pointing away from the ceramic pin 23 is concave and abuts on the rear surface of the two adjacent adaptors 11 (FIG. 3). On two opposite sides, each ceramic plate 27 is recessed for positive connection with the pipes 15 of the two adaptors 11 to prevent it from rotating about the axis of the pin 23.

The pressure exerted by the expansion mechanisms 22 on the adaptors 11 and the right-hand components 19 urges the adaptors 11 and the right-hand components 19 against the tube ends, so that the tubes 3 are forced against the left-hand components 19 which abut on the left-hand plate 5 of the housing.

Figure 4:
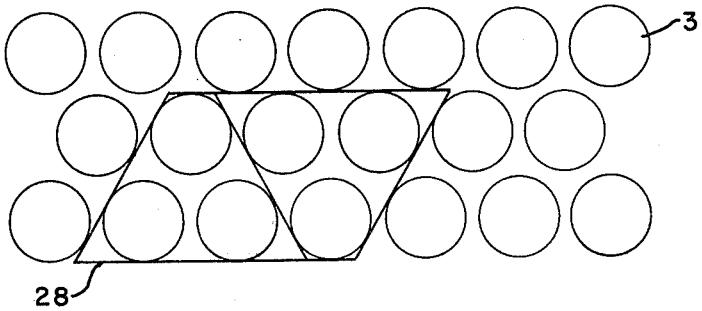
FIG. 4 is a rear view illustrating stacked tubes with modified components interconnecting three tubes at a time, in schematic representation.

FIG. 4 illustrates an alternative version of the component 19. The alternative version is an essentially triangular component 28 connected to which are the adjacent ends of three tubes at a time. As did the components 19, the components 28 are a contour fit one with the other, and their rear walls form a closed surface. The components 28 provide an advantage over the components 19 in that their position is statically determined; yet, the combination of three adjacent tube ends at a time has the disadvantage of the flow velocities and quantities varying from one row of tubes to the next.

Figure 5:
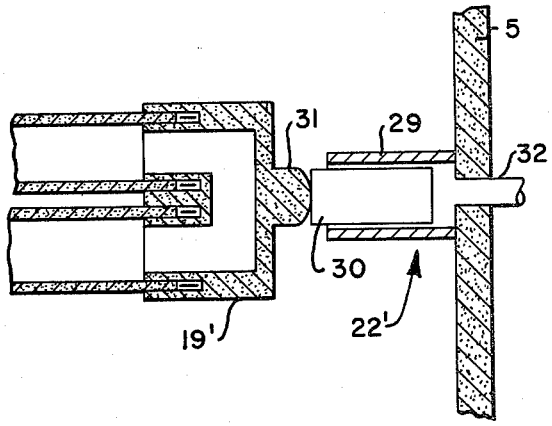
FIG. 5 is a sectional view illustrating an alternative version of the component and expansion mechanism illustrated in FIG. 1.

FIG. 5 illustrates an alternative design of the expansion mechanisms 22. The alternative design of the expansion mechanisms, indicated generally at 22', are compressed-air cylinders 29 each attached at its one end to the right-hand plate 5 of the housing. Provided in each cylinder 29 is a piston 30, one end of which projects beyond the open end of the cylinder pointing away from the plate 5 of the housing. The flow deflector component illustrated in FIG. 5 has, in lieu of the pipe end 26, a cam 31, formed on component 19', on which is the piston end projecting from the cylinder. The interior of the cylinder 29 communicates with a source of compressed air through a pipe 32 routed through the plate 5. When the piston 30 is pressurized with air, the piston 30 is urged against the cam 31 of the flow deflector component, the latter being pressed against the tube ends. The cylinder 29 and the pistons 30 alike can be made of a highly heat-resistant ceramic material. When the recuperator of the present invention is used together with the alternative design of expansion mechanism as illustrated in FIG. 5, the piston 30 and the cylinder 29 can also be pressurized with leakage air.

In a further modified embodiment, the place of the compressed-air cylinders 29 and the spring-loaded pins 23 can also be taken by a pressure chamber arranged in space 21, said pressure chamber being confined by the plate 5 of the housing and the rear surfaces of the components 19 and the adaptors 11 arranged at the right-hand tube ends and a surrounding chamber wall. The pressure built in the pressure chamber will then act directly on the rear surfaces of the components 19 and adaptors 11 arranged at the right-hand tube ends to urge them against the tube ends. Since the ends of the components and adaptors will be functioning in a manner somewhat analogous to pistons 30, to minimize air leaks, seals are imbedded between the components 19 and adaptors 11 arranged at the right-hand tube ends.

Figure 5A:
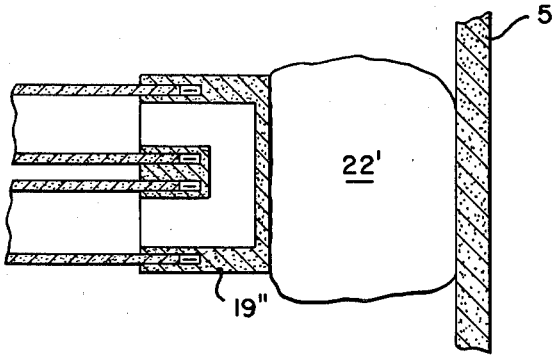
FIG. 5*a* is a further alternate version of the component and expansion mechanism.

Additionally, in a still further modified embodiment shown in FIG. 5*a*, the pressure chamber is defined by elastic foil. The foil is formed into a bag-like enclosure 22'' which is disposed between the ends of the connector components and adaptors, and the wall 5 in abutting relation thereto. The elastic enclosure 22' confines a compressible medium such as air and thus is able to deform so as to facilitate the positional changes of the components 19'' and adaptors. Foil of a highly heat-resistant material suitable for this purpose and of about 0.1 mm thick is commercially available. The foil need not be a totally enclosed bag, but also can be provided as a skin over the rear surfaces of the components, the edge of the foil being fastened to wall 5 in an air-tight manner. Likewise, a pressure chamber could be defined by a cylinder which has a flexible foil draped over its end facing the tube ends.

The pressure to be built in the pressure chamber can, whether a foil is used or not, be developed using compressor air, should the recuperator of the present invention be used on a vehicular gas turbine engine.

Axial clamping of the tubes 3 by means of the expansion mechanisms or the pressure chamber will compensate internal tensile stresses and, partially, thermal stresses in the tubes.

Figure 6:
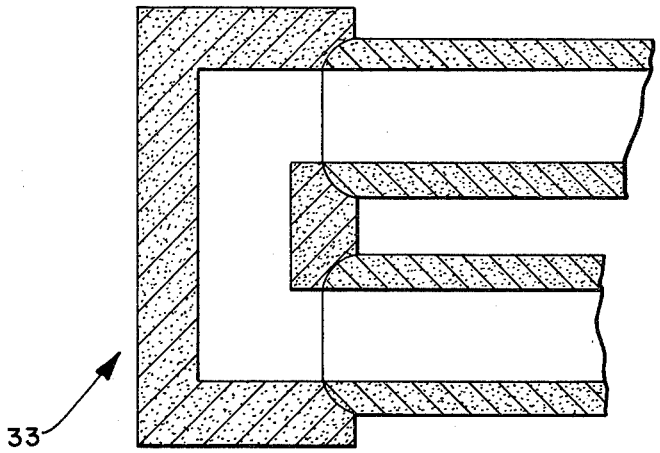
FIG. 6 is a sectional view illustrating a further alternative version of the component illustrated in FIG. 1, with suitably formed tube ends.

FIG. 6 illustrates a further alternative design of the deflection components 19. The component 33 shown in FIG. 6 has, instead of annular slots, spherically formed bearing surfaces which engage the tube ends which are appropriately crowned and are urged against these surfaces. The need for additional sealing will be obviated with this design. This version provides an advantage in that it facilitates the assembly of the recuperator and in that minor rotational movements of the tubes about the tube ends will not entail leakage between the tubes and the components. The adaptors 11 and their associated tube ends can also be formed in accordance with the design illustrated in FIG. 6.

Figure 7:
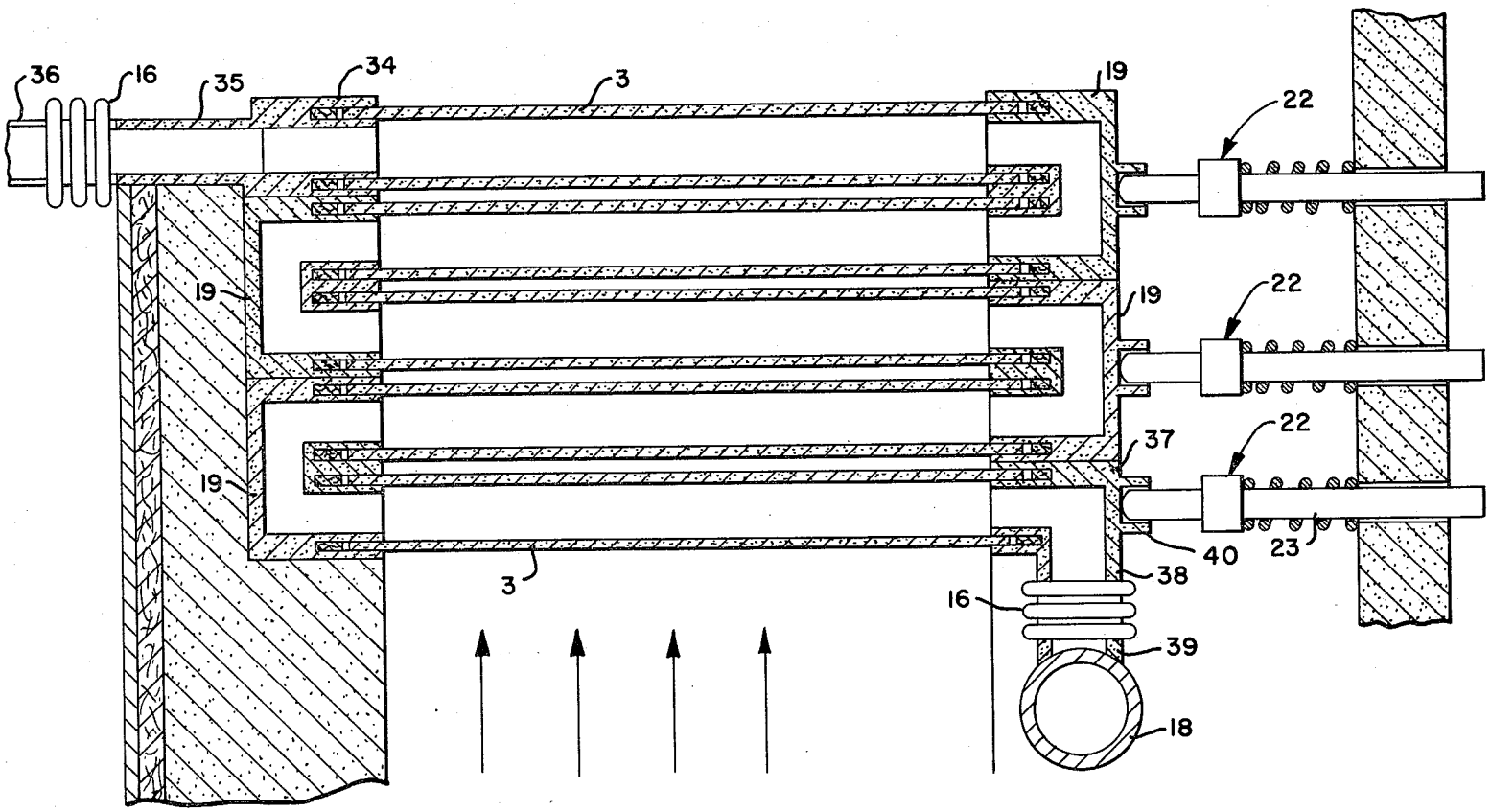
FIG. 7 is a sectional view illustrating a recuperator of the present invention with an alternative arrangement of modified adaptors for the entry and exit of the flow.

FIG. 7 illustrates an alternative arrangement of modified adaptors, where the adaptors 34 for the uppermost row of tubes are arranged on the left-hand side of the stack of tubes. Each adaptor 34 arranged on the left-hand side has on this left-hand side, the one pointing away from the tubes, a pipe 35 leading through the wall of the housing. Outside the housing the pipe 35 is connected to the metal bellows 16 which communicates with a further pipe 36 leading to the upper of the two rigid pipes 18.

Each adaptor 37 connected to the tubes 3 of the lowermost row of tubes has on its underside a pipe 38 pointed downward and connected to the metal bellows 16. Connected to the metal bellows 16 is a short end of pipe 39 leading to the lower rigid pipe 18. On its rear side each adaptor has a pipe 40 for engagement with the ceramic pin 23. In this version the adaptors 37 arranged below on the right-hand side are urged against the tube ends by the expansion mechanism 22 exactly as are the right-hand components.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A recuperator for a gas turbine for heat exchange between two flow media of dissimilar temperatures, comprising a housing for containing the flow of a first of the two flow media, a plurality of essentially parallel slidable supported tubes containing the flow of the second flow medium being arranged in said housing, said tubes being made of a highly heat-resistant ceramic material and extending at right angles to the direction of flow of the first flow medium through the housing and spaced to permit flow thereof around the tubes, plural sets of flow deflection connector means located within said housing for interconnecting at least two tubes at a time at adjacent ends to create a meandering flow of the second medium through the tubes by deflecting the flow from the one tube into another tube, each of said sets having a plurality of separate flow deflection connector means, a first of said sets being positioned against a wall of said housing containing said first flow and engaging respective first ends of said tubes, and expansion pressure means acting on a surface of each respective connector means of a second of said sets which faces away from respective second ends of the tubes for urging the second set of connector means against the second ends of the slidable supported tubes associated therewith, wherein said pressure means comprises an expansion mechanism which applies a resilient biasing pressure and is located between a first wall of the housing and those of said connector means that are arranged at the second ends of the tubes to urge the connector means against the second ends of the tubes, causing the tubes to be urged against the first set of connector means arranged at the first ends of the tubes and abutted against said housing wall, wherein each connector means of said sets of connector means has a number of annular slots corresponding to the number of tubes to be connected to it, in which slots are slidably inserted the adjacent ends of the tubes to be connected to this connector means, with a seal of highly heat-resistant material installed in each annular slot between the tube end inserted into this annular slot and the bottom of the annular slot.

2. A recuperator according to claim 1, wherein the seal is formed of a highly heat-resistant felt material.

3. A recuperator according to claims 1, wherein the tubes are arranged and stacked in layers and the connector means at respective ends thereof are snugly fitted one to the other, so as to form a closed surface area.

4. A recuperator according to claim 3, wherein the tubes extend horizontally the ends of at least two tubes of respective uppermost and lowermost layers of said tubes are connected to an adaptor for the influx and the efflux, respectively, of the second flow medium, and wherein connector means of the layer of tubes adjacent said uppermost and lowermost layers are fitted snugly to the adaptors.

5. A recuperator according to claim 3, wherein each connector means interconnects the adjacent tube ends of three tubes at a time, said connector means being essentially triangular for deflecting the flow from one tube into the two other tubes at one end thereof, and from two tubes into the other tube of the other end thereof.

6. A recuperator according to claim 1, wherein the tubes extend horizontally the ends of at least two tubes of respective uppermost and lowermost layers of said tubes are connected to an adaptor for the influx and efflux, respectively, of the second flow medium, and wherein connector means of the layer of tubes adjacent said uppermost and lowermost layers are fitted snugly to the adaptors.

7. A recuperator according to claim 1, wherein said expansion means comprises a pressure chamber arranged between a first wall of the housing and the second set of connector means, in which pressure chamber the pressure prevailing in operation acts on the connector means to urge them against the second tube ends interconnected thereby for causing the tubes to be urged against the first set of connector means interconnecting the first tube ends.

8. A recuperator according to claim 7, wherein the pressure chamber is confined by a surface of second set of the connector means which points away from the second tube ends and by the first wall of the housing.

9. A recuperator according to claim 7, wherein said pressure chamber is defined at least in part by an elastic foil of a highly heat resistant material arranged to act upon the connector means.

10. A recuperator according to claim 1 or 7, wherein two adjacent adaptors at a time are urged against the second ends of the tubes connected to the two adaptors by means of a single expansion pressure means.

11. A vehicular gas turbine engine having a regenerative heat exchanger of a ceramic material in association with a recuperator according to claims 1 or 7 whereby a hot stream of exhaust gas, when issuing from the turbine, will first flow through the recuperator and then through the regenerative ceramic heat exchanger.

* * * * *